US006227889B1

(12) United States Patent
Wu

(10) Patent No.: US 6,227,889 B1
(45) Date of Patent: May 8, 2001

(54) TELECOMMUNICATION SWITCHING CONNECTOR

(75) Inventor: Pei-Chih Wu, Taipei (TW)

(73) Assignee: Advanced Optronics Corporation, Taoyuan (TW)

( * ) Notice: Subject to any disclaimer, the term of this patent is extended or adjusted under 35 U.S.C. 154(b) by 0 days.

(21) Appl. No.: 09/569,051

(22) Filed: May 10, 2000

(51) Int. Cl.[7] ..... H01R 29/00
(52) U.S. Cl. ..... 439/188; 439/668; 439/944
(58) Field of Search ..... 439/188, 668, 439/669, 752, 944

(56) References Cited

U.S. PATENT DOCUMENTS 4,633,048 * 12/1986 Komatsu ..... 200/51.1
4,937,404 * 6/1990 Kitagawa ..... 200/51.09
5,338,215 * 8/1994 Lee et al. ..... 439/188
5,893,767 * 4/1999 Broschard, III ..... 439/188
6,056,602 * 5/2000 Wu ..... 439/668
6,077,126 * 6/2000 Peng ..... 439/668

* cited by examiner

*Primary Examiner*—Brian Sircus
*Assistant Examiner*—Thanh-Tam Le
(74) *Attorney, Agent, or Firm*—Robert E. Bushnell, Esq.

(57) ABSTRACT

A telecommunication switching connector constructed to include a base holding a first metal spring plate, a second metal spring plate and a third metal spring plate at one lateral side and a tubular signal terminal on the middle, a cover covered on the base to hold the metal spring plates and the tubular signal terminal, wherein the first metal spring plate, the second metal spring plate and the third metal spring plate are disposed in contact with one another, forming a first transmission loop before insertion of a plug connector into the telecommunication switching connector; the third metal spring plate is forced away from the second metal spring plate and form with the first metal spring plate a second transmission loop after insertion of a plug connector into the telecommunication switching connector and contact of the central signal terminal of the inserted plug connector with the tubular signal terminal.

7 Claims, 6 Drawing Sheets

TELECOMMUNICATION SWITCHING CONNECTOR

BACKGROUND OF THE INVENTION

The present invention relates to electric connectors, and more specifically to a telecommunication switching connector.

FIGS. 9 and 10 show a telecommunication switching connector for use in a telecommunication switching system to switch the transmission of signal. This structure of telecommunication switching connector comprises a shell A, the shell A having a locating rods A1 and a terminal receiving groove A2, a tubular signal terminal A3 installed in the terminal receiving groove A2, and three metal spring plates A4 respectively mounted in the shell A and supported on the locating rods A1. Before insertion of a plug connector B into the telecommunication switching connector, the rear metal spring plate A4 and the intermediate metal spring plate A6 are disposed in contact with each other, forming a first transmission loop. After insertion of a plug connector B into the telecommunication switching connector, the rear metal spring plate A4 is forced away from the intermediate metal spring plate A6, and the front metal spring plate A5 is forced into contact with the intermediate metal spring plate A6, forming a second transmission loop. This structure of telecommunication switching connector is still not satisfactory in function. The main drawback of this structure of telecommunication switching connector is that simply using the locating rods to support the metal spring plates cannot keep the metal spring plates firmly in place, and the metal spring plates tend to be forced out of place upon insertion of a plug connector into the telecommunication switching connector, causing a signal transmission error.

SUMMARY OF THE INVENTION

The present invention has been accomplished to provide a telecommunication switching connector, which eliminates the aforesaid problem. According to one aspect of the present invention, the telecommunication switching connector is constructed to include a base holding a first metal spring plate, a second metal spring plate and a third metal spring plate at one lateral side and a tubular signal terminal on the middle, a cover covered on the base to hold the metal spring plates and the tubular signal terminal, wherein the first metal spring plate, the second metal spring plate and the third metal spring plate are disposed in contact with one another, forming a first transmission loop before insertion of a plug connector into the telecommunication switching connector; the third metal spring plate is forced away from the second metal spring plate and form with the first metal spring plate a second transmission loop after insertion of a plug connector into the telecommunication switching connector and contact of the central signal terminal of the inserted plug connector with the tubular signal terminal. According to another aspect of the present invention, the base comprises a groove, and a plurality of spring plate mounting holes spaced in the groove, which receive the metal spring plates respectively; the cover has a plurality of bottom positioning rods respectively inserted into the spring plate mounting holes to hold down the metal spring plates in the respective spring plate mounting holes.

DETAILED DESCRIPTION OF THE PREFERRED EMBODIMENT

Figure 1:
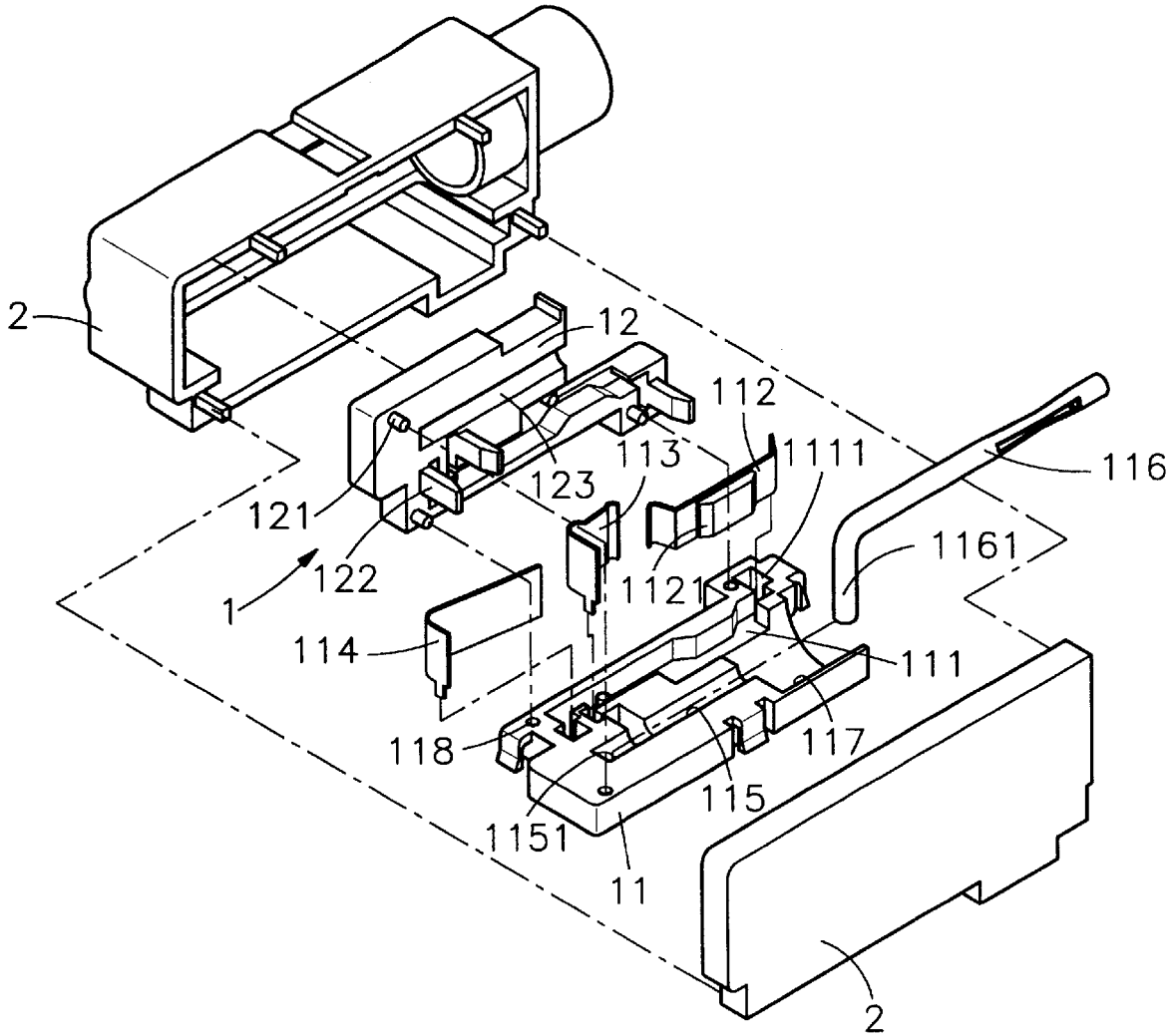
FIG. 1 is an exploded view of a telecommunication switching connector according to the present invention.
Figure 2:
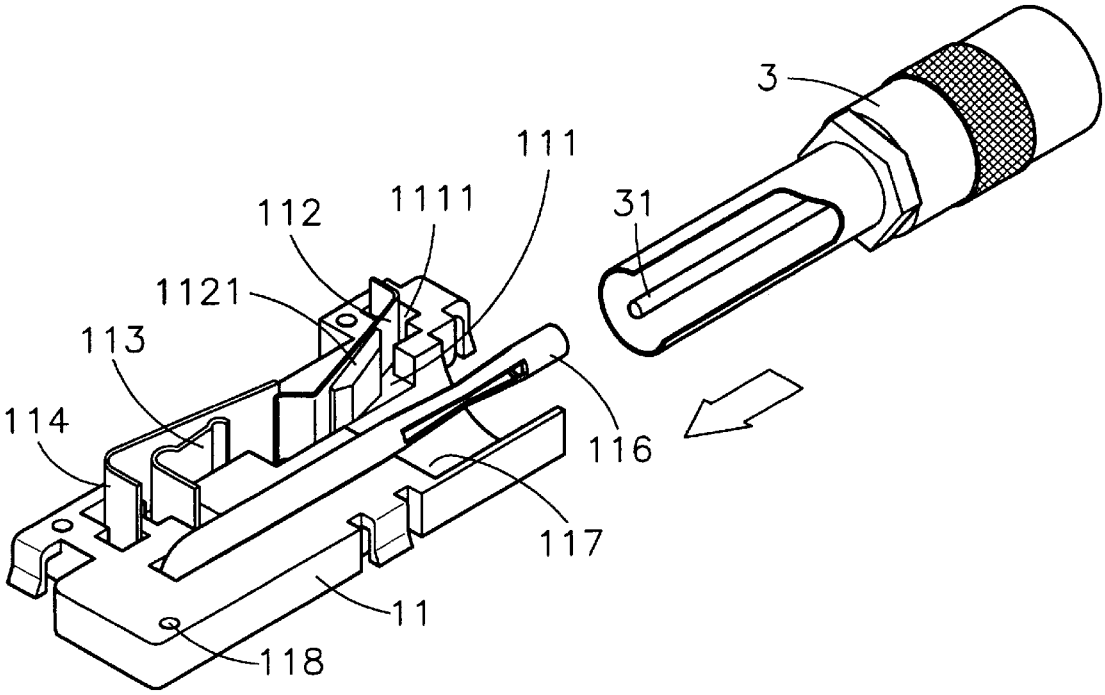
FIG. 2 illustrates the relationship between the telecommunication switching connector and a matching plug connector according to the present invention (where the cover and the housing of the telecommunication switching connector excluded).
Figure 3:
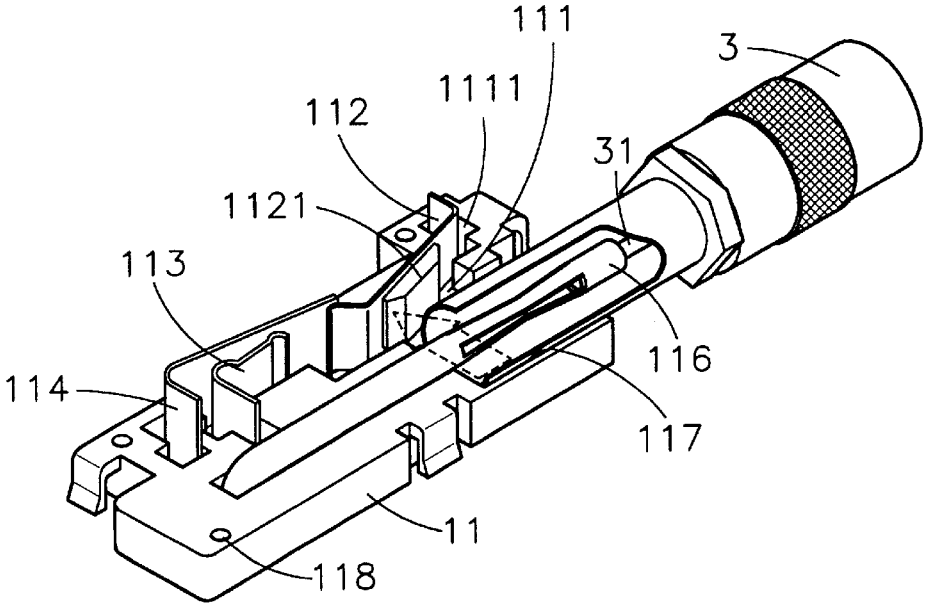
FIG. 3 is similar to FIG. 2 but showing the plug connector connected to the telecommunication switch connector.
Figure 4:
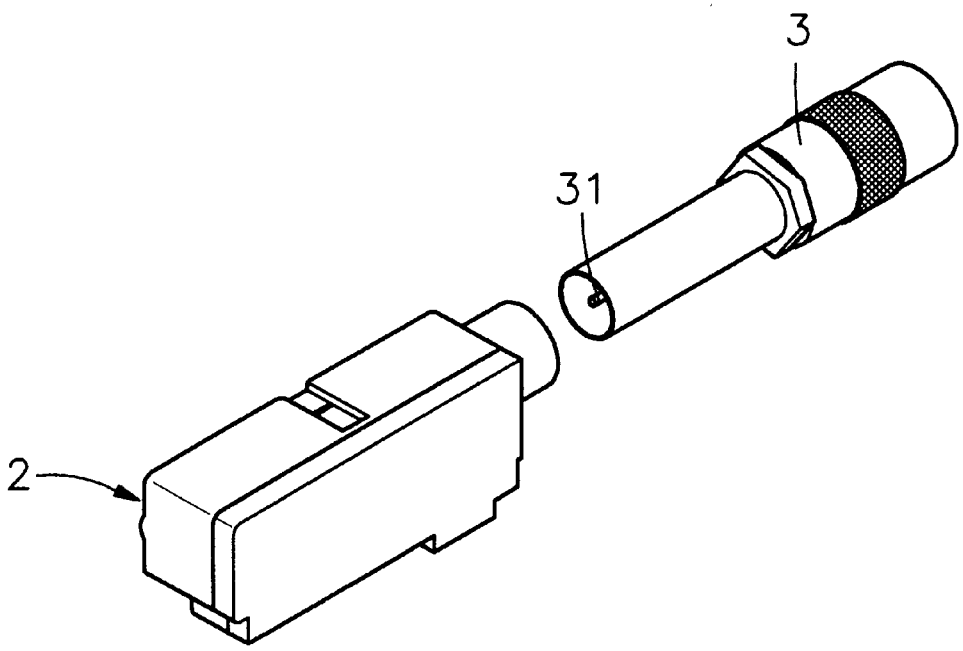
FIG. 4 illustrates the outer appearance of the telecommunication connector and the relationship between the telecommunication connector and the matched plug connector according to the present invention.
Figure 5:
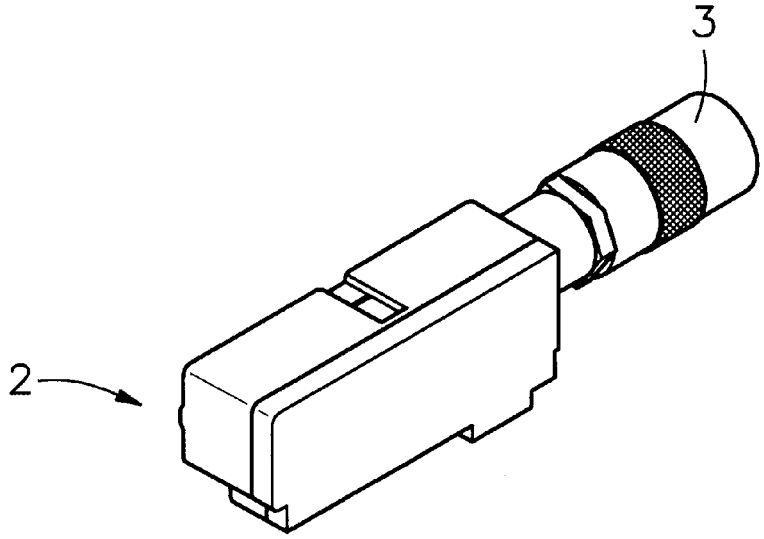
FIG. 5 is similar to FIG. 4 but showing the plug connector connected to the telecommunication switching connector.
Figure 6:
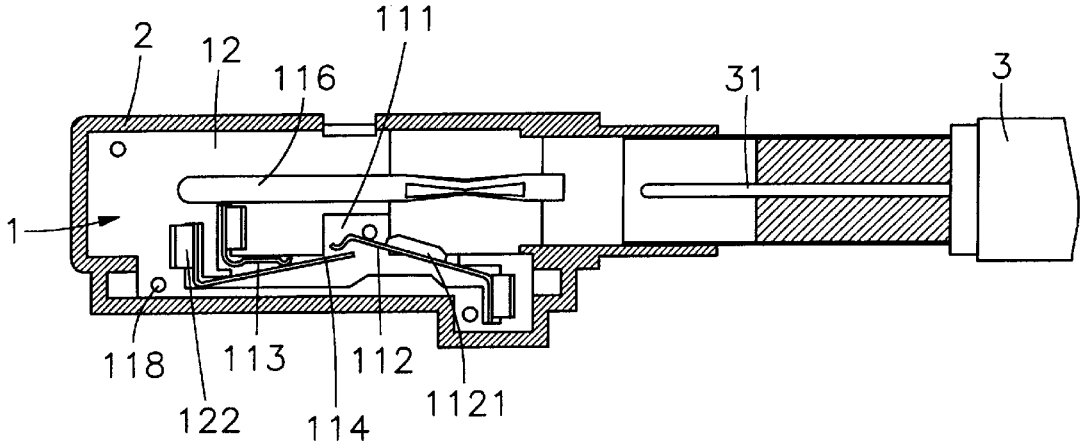
FIG. 6 is a sectional view showing the initial stage of the insertion of a plug connector into the telecommunication switching connector according to the present invention.
Figure 7:
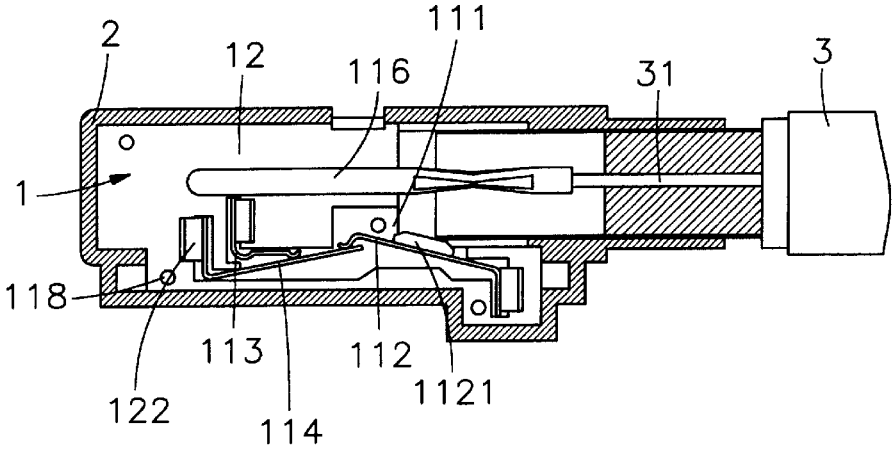
FIG. 7 is similar to FIG. 8 but showing the central signal terminal of the plug connector disposed in contact with the tubular signal terminal of the telecommunication switching connector.
Figure 8:
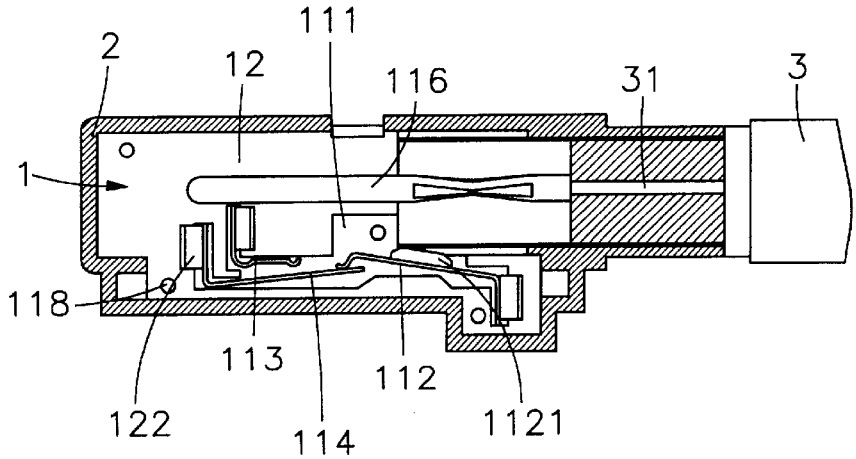
FIG. 8 is similar to FIG. 7 but showing the third metal spring plate disconnected from the second metal spring plate and maintained in contact with the first metal spring plate.
Figure 9:
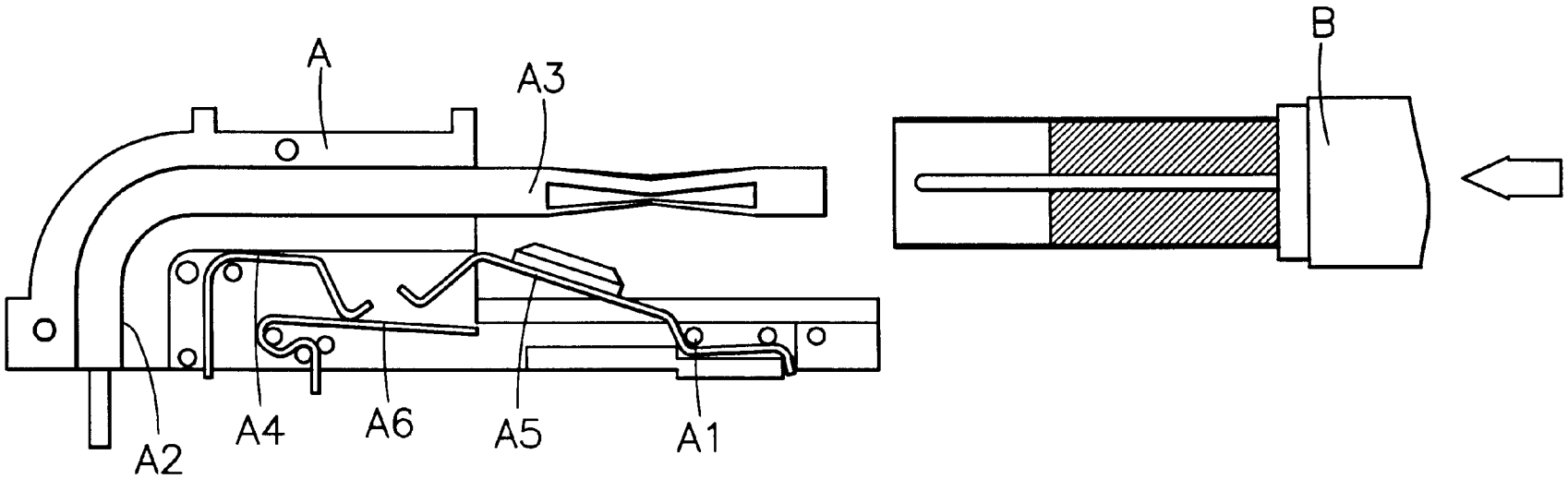
PRIOR ART FIG. 9
FIG. 9 is a sectional view showing the relationship between a telecommunication switching connector and a plug connector according to the prior art.
Figure 10:
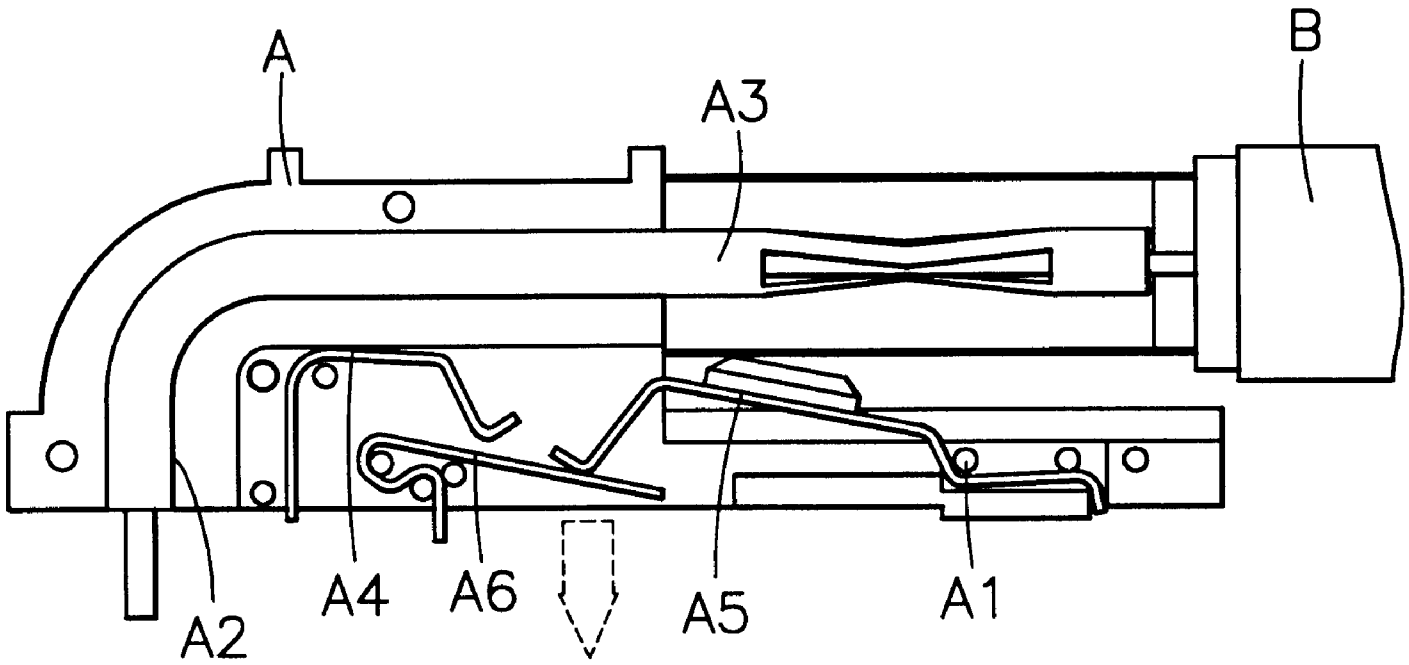
PRIOR ART FIG. 10
FIG. 10 is similar to FIG. 9 but showing the plug connector inserted into the telecommunication switching connector.

Referring to FIGS. from 1 through 3, a telecommunication switching connector is shown comprised of a body 1 formed of a base 11 and a cover 12, and a housing 2, which receives the body 1 and protects the body 1 against electromagnetic interference. The base 11 comprises a longitudinal groove 111, a plurality of spring plate mounting holes 1111 spaced in the longitudinal groove 111, a first metal spring plate 112, a second metal spring plate 113 and a third metal spring plate 114 respectively mounted in the spring plate mounting holes 1111, a longitudinal receiving chamber 115 on the middle, an insertion hole 1151 through one end of the receiving chamber 115, a tubular signal terminal 116 longitudinally mounted in the receiving chamber 115, the tubular signal terminal 116 having a rear end 1161 bent through 90° and extended out of the base 11 through the insertion hole 1151, a sliding way 117 disposed in front of the elongated receiving chamber 115 for receiving a plug connector 3, for enabling the central signal terminal 31 of the plug connector 3 to be inserted into the tubular signal terminal 116 to make an electric contact for signal transmission, and a plurality of mounting holes 118. The first spring plate 112 has a protruded bearing portion 1121. The cover 12 is covered on the base 11, comprising a plurality of bottom mounting rods 121 respectively press-fitted into the mounting holes 118 on the base 11, three bottom positioning rods 122 respectively inserted into the spring plate mounting holes 1111 on the base 11 to hold the spring plates 112, 113 and 114 in place, and a longitudinal receiving chamber 123 matching the longitudinal receiving chamber 115 on the base 11. The bottom positioning rods 122 each have a beveled bottom guide edge for quick positioning.

Referring to FIGS. from 4 through 8, before insertion of the plug connector 3 into the telecommunication switching connector, the second metal spring plate 113 and the third metal spring plate 114 are disposed in contact with each other, forming a transmission loop. When inserting the plug connector 3 into the telecommunication switching connector, the protruded bearing portion 1121 of the first metal spring plate 112 is forced outwards by the shell of the plug connector 3, causing the first metal spring plate 112 to be deformed and forced into contact with the third metal spring plate 114, and therefore the first metal spring plate 112, the second metal spring plate 113 and the third metal spring plate 114 are electrically connected to one another, forming a transmission loop. Continuously inserting the plug connector 3 into the telecommunication switching connector, the third metal spring plate 114 is deformed and electrically disconnected from the third metal spring plate 113, thereby causing the transmission loop of the second metal spring plate 113 and the third metal spring plate 114 to be switched to the transmission loop of the first metal spring plate 112 and the third metal spring plate 114.

While only one embodiment of the present invention has been shown and described, it will be understood that various modifications and changes could be made thereunto without departing from the spirit and scope of the invention disclosed.

What the invention claimed is:

1. A telecommunication switching connector comprising:

a base, said base comprising a longitudinal groove, and a plurality of spring plate mounting holes spaced in said longitudinal groove, a first metal spring plate, a second metal spring plate and a third metal spring plate respectively mounted in said spring plate mounting holes;

a tubular signal terminal longitudinally installed in said base on a middle for contacting a signal terminal of a plug connector to be inserted into the telecommunication switching connector; and a cover covered on said base to hold said first metal spring plates said second metal spring plate, said third metal spring plate and said tubular signal terminal in places said cover comprising a plurality of bottom positioning rods respectively inserted into said spring plate mounting holes to hold down said first metal spring plate, said second metal spring plate and said third metal spring plate;

wherein said second metal spring plate and said third metal spring plate are disposed in contact with one another, forming a first transmission loop before insertion of a plug connector into the telecommunication switching connector;

said third metal spring plate is forced away from said second metal spring plate and said first metal spring plate contacts with said first metal spring plate to form a second transmission loop after insertion of a plug connector into the telecommunication switching connector.

2. The telecommunication switching connector of claim 1 wherein said base comprises a longitudinal receiving chamber and an insertion hole at one end of said longitudinal receiving chamber; said tubular signal terminal is mounted in said longitudinal receiving chamber, having a rear end extended out of said base through the insertion hole at one end of said longitudinal receiving chamber.

3. The telecommunication switching connector of claim 2 wherein said base comprises a sliding way disposed in front of said longitudinal receiving chamber for guiding in the plug connector being inserted into the telecommunication switching connector, enabling a central terminal of the plug connector to be inserted into said tubular signal terminal to make an electric contact.

4. The telecommunication switching connector of claim 3 wherein said first metal spring plate is disposed at one side of said sliding way, having a protruded bearing portion, that supports a part of the plug connector inserted into the telecommunication switching connector.

5. The telecommunication switching connector of claim 1 wherein said base comprises a plurality of mounting holes, and said cover comprises a plurality of bottom mounting rods respectively press-fitted into the mounting holes on said base.

6. The telecommunication switching connector of claim 1 wherein said bottom positioning rods of said base each have a beveled bottom guide edge.

7. The telecommunication switching connector of claim 1 further comprising a housing, which receives said body and said cover to protect the telecommunication switching connector against electromagnetic interference.

* * * * *